US008482215B2

(12) United States Patent
Tan et al.

(10) Patent No.: US 8,482,215 B2
(45) Date of Patent: Jul. 9, 2013

(54) LIGHT EMITTING APPARATUS AND CONTROL METHOD THEREOF

(75) Inventors: Zeu-Chia Tan, Hsin-Chu (TW); Chi-Chui Yun, Hsin-Chu (TW); Jia-Bin Huang, Hsin-Chu (TW)

(73) Assignee: Young Optics Inc. (TW)

( * ) Notice: Subject to any disclaimer, the term of this patent is extended or adjusted under 35 U.S.C. 154(b) by 581 days.

(21) Appl. No.: 12/662,905

(22) Filed: May 11, 2010

(65) Prior Publication Data

US 2010/0289432 A1 Nov. 18, 2010

(30) Foreign Application Priority Data

May 18, 2009 (TW) ..... 98116399 A

(51) Int. Cl.
*H05B 37/02* (2006.01)

(52) U.S. Cl.
USPC ..... 315/291; 315/308; 315/309

(58) Field of Classification Search
USPC ..... 315/291, 50, 118, 112, 117, 185 R, 315/297, 307–309
See application file for complete search history.

(56) References Cited

U.S. PATENT DOCUMENTS

| | | | | |
|---|---|---|---|---|
| 7,252,385 | B2 | 8/2007 | Engle et al. | |
| 8,269,716 | B2 * | 9/2012 | Shen | 345/102 |
| 2003/0066945 | A1 * | 4/2003 | Muthu et al. | 250/205 |
| 2009/0278477 | A1 * | 11/2009 | Yang et al. | 315/308 |
| 2009/0302783 | A1 * | 12/2009 | Wang et al. | 315/307 |
| 2010/0176746 | A1 * | 7/2010 | Catalano et al. | 315/297 |

FOREIGN PATENT DOCUMENTS

| | | |
|---|---|---|
| CN | 1856207 A | 11/2006 |
| CN | 101046286 A | 10/2007 |
| TW | 287561 | 2/2006 |
| TW | 200731203 | 8/2007 |
| TW | 200734993 | 9/2007 |

OTHER PUBLICATIONS

Zeu-Chia Tan et al., Chinese Office Action dated Aug. 3, 2012, Application No. 2009101496855, filed Jun. 19, 2009 (9 pages including translation).

* cited by examiner

*Primary Examiner* — Jimmy Vu
*Assistant Examiner* — Henry Luong
(74) *Attorney, Agent, or Firm* — MH2 Technology Law Group, LLP

(57) ABSTRACT

A light emitting apparatus and a control method thereof are provided. The light emitting apparatus has a semiconductor device capable of emitting light, and the control method includes the following descriptions. A driving power of the semiconductor device is reduced to an ideal power stepwise and gradually. After every time the driving power of the semiconductor device is reduced, the semiconductor device continually emits the light by the reduced driving power within a predetermined time.

18 Claims, 4 Drawing Sheets

LIGHT EMITTING APPARATUS AND CONTROL METHOD THEREOF

CROSS-REFERENCE TO RELATED APPLICATION

This application claims the priority benefit of Taiwan application serial no. 98116399, filed on May 18, 2009. The entirety of the above-mentioned patent application is hereby incorporated by reference herein and made a part of this specification.

BACKGROUND OF THE INVENTION

1. Field of the Invention

The invention generally relates to a photoelectric apparatus and a control method, and more particularly, to a light emitting apparatus and the control method.

2. Description of Related Art

The light emitting principle of the semiconductor device used for emitting light uses the special character of the semiconductor device and is different from the light emitting principle of the general fluorescent lamp and the incandescent lamp. The semiconductor devices used for emitting light have many kinds. The light emitting diode has the advantages of high illumination output, small volume, low driving voltage, and mercury free, so the light emitting diode is widely used in illumination and display apparatus area.

To make the light emitting diode be used in all kinds of products, the institution of rule becomes very important. Generally speaking, a rated driving power of the light emitting diode is an important parameter to determine the light emitting power, and when the light emitting diode operates, the light emitting diode is driven by the rated driving power. However, the rated driving power is not the only parameter affecting the light emitting power of the light emitting diode. When a junction temperature of the light emitting diode rises, the light emitting power of the light emitting diode reduces. Seriously, the light emitting power of the light emitting diode with high rated driving power and high junction temperature may be less than the light emitting power of the light emitting diode with low rated driving power and low junction temperature.

For example, as shown in FIG. 1, the X-coordinate stands for the operating time of the light emitting diode, the Y-coordinates in the left and right sides are respectively stand for the junction temperature and the light emitting power of the light emitting diode, curves T16 and L16 respectively stand for the characteristic curve of the light emitting diode when the rated driving power is 1.6 watt, and curves T10 and L10 respectively stand for the characteristic curve of the light emitting diode when the rated driving power is 1 watt. The curves T16 and T10 respectively stand for the relation between the junction temperature and the time of the light emitting diode when the rated driving power is respectively 1.6 watt and 1 watt, and the curves L16 and L10 respectively stand for the relation between the light emitting power and the time of the light emitting diode when the rated driving power is respectively 1.6 watt and 1 watt.

From above, from the curves L16 and L10, when the two light emitting diodes emit light, the light emitting power (about 301 mW) of the light emitting diode with the rated driving power 1.6 watt is more than the light emitting power (about 244 mW) of the light emitting diode with the rated driving power 1 watt. In addition, from the curves T16 and T10, although the junction temperature of the light emitting diode with the rated driving power 1.6 watt is more than the junction temperature of the light emitting diode with the rated driving power 1 watt, and the temperatures of the two light emitting diodes have less differences.

However, after the above-mentioned two light emitting diodes emit the light continuously for 6000 seconds (about 1.6 hours), the light emitting power of the light emitting diode with the rated driving power 1.6 watt has reduced to about 174 mW, and is less than the light emitting power (about 176 mW) of the light emitting diode with the rated driving power 1 watt. The junction temperature of the light emitting diode with the rated driving power 1.6 watt is higher than the junction temperature of the light emitting diode with the rated driving power 1 watt.

From the above, during the time of continuously emitting the light for 6000 seconds, the light emitting diode with rated driving power 1.6 watt has bigger temperature programming than the light emitting diode with rated driving power 1 watt, so the light emitting diode with rated driving power 1.6 watt has more power consumption and the light emitting power is reduced as a result.

SUMMARY OF THE INVENTION

The invention provides a control method of a light emitting apparatus, and the control method may save the power consumption.

The invention provides a light emitting apparatus, and the consuming power of the light emitting apparatus is reduced.

Other objectives and advantages may be further understood from the disclosed technical characters of the invention.

To achieve at one of the objectives or other objectives, one embodiment of the invention provides a control method, wherein the light emitting apparatus has a semiconductor device capable of emitting light, and the control method is described as following. A driving power of the semiconductor device is reduced to an ideal power stepwise and gradually, and the semiconductor device continually emits the light by the reduced driving power within a predetermined time after every time the driving power of the semiconductor device is reduced.

One embodiment of the invention provides a light emitting apparatus including a semiconductor device and a control unit, wherein the semiconductor device is capable of emitting light, and the control unit is electrically connected to the semiconductor device. In addition, the control unit is capable of reducing a driving power of the semiconductor device to an ideal power stepwise and gradually, wherein the semiconductor device continually emits the light by the reduced driving power within a predetermined time after every time the driving power of the semiconductor device is reduced.

In the above-mentioned embodiment, since adopting the control method of reducing a driving power of the semiconductor device to an ideal power stepwise and gradually, the power consumption of the light emitting apparatus is saved.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

In the embodiment, the semiconductor device used to emit light in the light emitting apparatus may be a light emitting diode, a laser diode or other semiconductor devices capable of emitting light. In the following embodiments, the semiconductor device used to emit light mainly uses the light emitting diode as an example to conveniently describe, but the invention is not to limit the following embodiments.

In consideration of the light emitting power of the light emitting diode with high rated driving power and high junction temperature may be less than the light emitting power of the light emitting diode with low rated driving power and low junction temperature, the embodiment of the invention may reduce the power consumption of the light emitting diode through dynamically adjusting the driving power. The method of dynamically adjusting the driving power is listed as follows, but the invention is not to limit that the following embodiments are all the embodiments of the invention.

The First Embodiment

Figure 1:
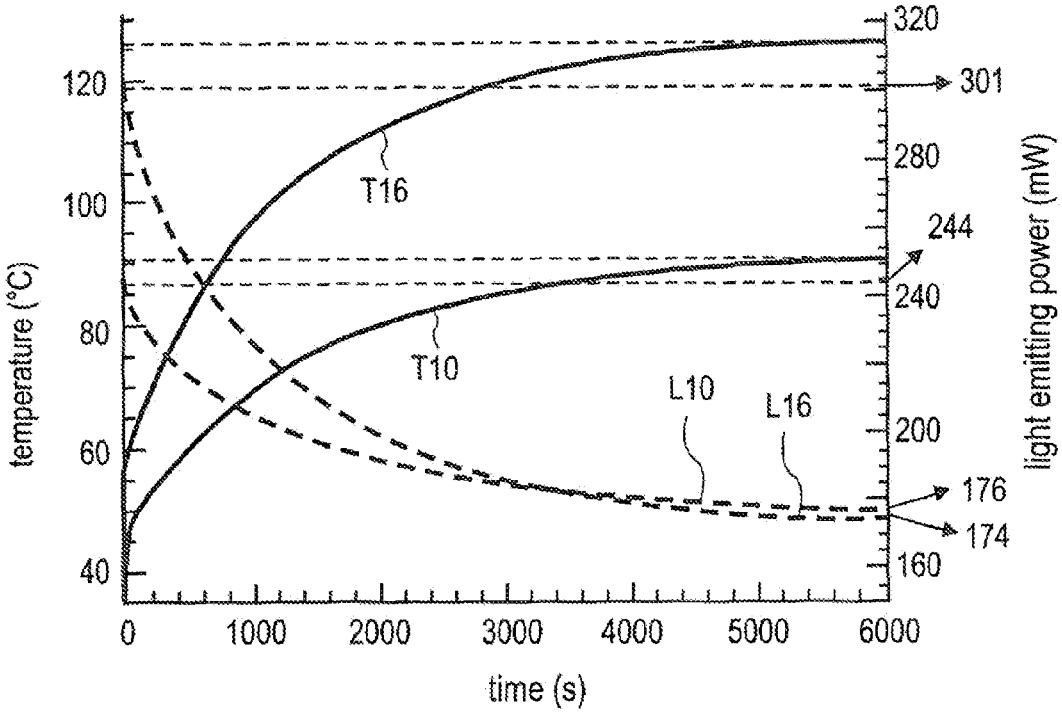
Fig. 1 (Prior Art)
FIG. 1 is a diagram showing the comparing relations of the temperature, operating time, and the light emitting power of two kinds of conventional light emitting diodes.
Figure 2:
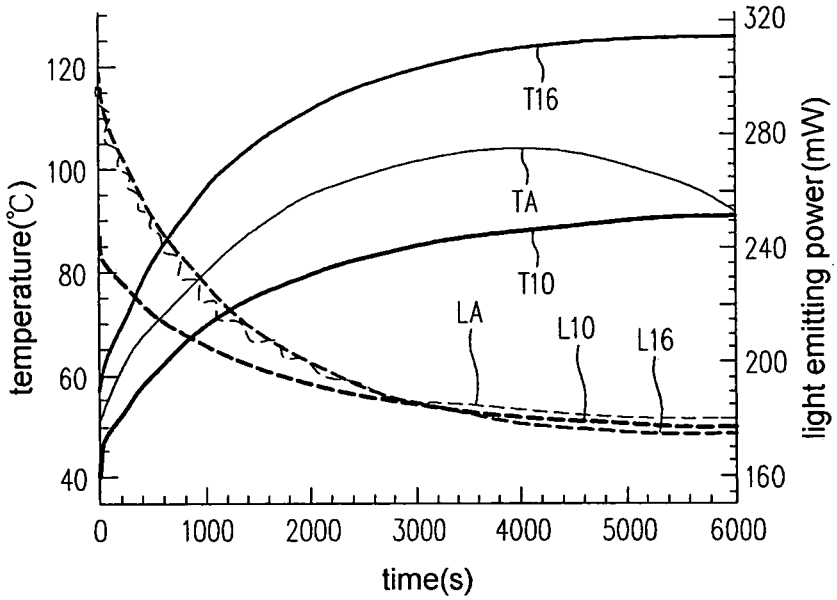
FIG. 2 is a diagram showing the comparing relations of the temperature, operating time, and the light emitting power of three kinds of light emitting diodes according to the first embodiment of the invention.

Referring to FIG. 2, curves LA and TA are the characteristic curves according to dynamically adjusting the driving power of the light emitting diode of the first embodiment of the invention, the curve LA stands for the relation between the light emitting power and the time of the adjusted light emitting diode, and the curve TA stands for the relation between the junction temperature and the time of the adjusted light emitting diode. The meaning of the curves L16, T16, L10, and T10 may refer to the above descriptions about FIG. 1 and is not described here. To be convenient for describing, in the following, the driving power of the light emitting diode is dynamically adjusted according to the embodiment of the invention, and the light emitting diode is called an object light emitting diode for short.

From above, the object light emitting diode is driven by the driving power 1.6 watt initiatively. From the curves LA, L16, and L10, the initiative light emitting power of the object light emitting diode and light emitting diode with a rated driving power 1.6 watt is about 301 mW, and the value is bigger than the initiative light emitting power (about 244 mW) of the light emitting diode with a rated driving power 1 watt.

Next, the driving power of the object light emitting diode is reduced stepwise and gradually, wherein the semiconductor device continually emits the light by the reduced driving power within a predetermined time after every time the driving power of the object light emitting diode is reduced. In the embodiment, the above predetermined time is 60 seconds for example, and the driving power of the object light emitting diode is adjusted by 0.006 watt per minute, and during the 60 seconds after every time the driving power is reduced by 0.006 watt, the object light emitting diode continuously emits light by the reduced driving power. From the curves TA and T16, through reducing the driving power of the object light emitting diode stepwise and gradually, the junction temperature of the object light emitting diode is lower than the junction temperature of the light emitting diode driven by the continuously rated driving power 1.6 watt. After the object light emitting diode continuously emits light for 6000 seconds, the driving power of the object light emitting diode has dropped to 1 watt, and the junction temperature of the object light emitting diode has dropped to a temperature substantially the same as the junction temperature of the light emitting diode with a rated driving power 1 watt.

Through the above method for reducing the driving power, a curve LA extremely similar to the curve L16 may be obtained, and the curve LA stands for that the object light emitting diode and the light emitting diode with the rated driving power 1.6 watt has approximately the same light emitting power in the 6000 seconds for emitting light continuously. However, the consuming power of the object light emitting diode is less than the consuming power of the light emitting diode with the rated driving power 1.6 watt. In other words, the object light emitting diode provides the same light emitting power with lower driving power and effectively reduces the consumption of the electrical energy. In addition, the junction temperature drops with the reduction of the driving power, so the life and reliability of the light emitting diode is improved.

The embodiment adopting stepwise and gradually reducing the driving power is mainly to avoid that the illumination of the light emitting diode becomes dark obviously, and the above-mentioned method of reducing the driving power 0.006 watt per minute is an example to describe stepwise and gradually reducing the driving power, but the real reducing amplitude is determined by the product.

In the embodiment, reducing the driving power of the light emitting diode may be achieved through reducing the driving current of the object light emitting diode. In more detail, if the above-mentioned object light emitting diode is driven by the 800 mA driving current and 1.6 watt driving power initially, and the driving current of the object light emitting diode is reduced by 15 mA per minute in 10 minutes for emitting light continuously, the driving current and the driving power of the object light emitting diode are respectively reduced to 650 mA and 1.16 watt after 10 minutes. The result may save 25%~30% electrical energy comparing with the conventional light emitting diode with the rated driving power 1.6 watt. However, the invention is not to limit the method of reducing the driving power. For example, the method of reducing the driving power of the light emitting diode may also be achieved by reducing the duty cycle of the driving voltage, driving voltage, and so on.

The Second Embodiment

The second embodiment is similar to the first embodiment, a safe temperature value of the semiconductor device may be further considered when the second embodiment adjusts the driving power, and the final temperature of the semiconductor device is maintained at the safe temperature value. In addition, if the diagram of the embodiment has the same or similar labels with the diagram of the above-mention embodiment, the labels stand for the same or similar components, and the description is omitted here.

In practical use, a safe temperature value is generally set for the product. If a user uses the product in the environment with the temperature exceeding the safe temperature value, the product may produce wrong actions and even be damaged forever, so the set of the safe temperature value may ensure that the product operates normally. Besides adopting the concept of the first embodiment, the embodiment further considers the safe temperature value of the semiconductor device to adjust the driving power. However, the so-called safe temperature value is changed with the using environment of the practical product, and the safe temperature value of the following embodiment is described through some examples and is not to limit the invention.

Figure 3A:
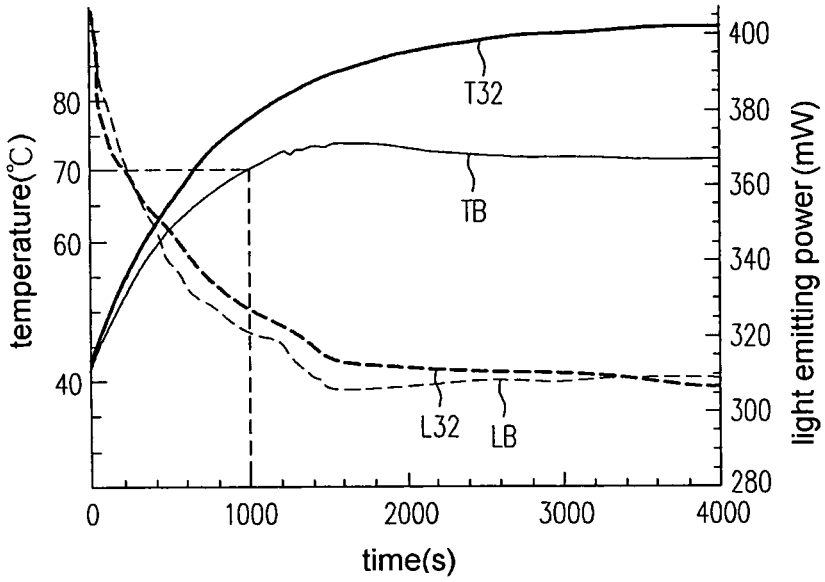
FIG. 3A is a diagram showing the comparing relations of the temperature, operating time, and the light emitting power of two kinds of light emitting diodes according to the second embodiment of the invention.

In the embodiment, when the semiconductor device achieves the safe temperature value, the action of adjusting driving power starts. Taking the light emitting diode as an example and referring to FIG. 3, curves T32 and L32 stand for the characteristic curves of the light emitting diode with the rated driving power 3.2 watt, and curves TB and LB stand for the characteristic curves of the object light emitting diode. The curves T32 and TB respectively stand for the relation between the junction temperature and the time of the light emitting diode with the rated driving power 3.2 watt and the object light emitting diode, and the curves L32 and LB respectively stand for the relation between the light emitting power and the time of the light emitting diode with the rated driving power 3.2 watt and the object light emitting diode.

From above, the above-mentioned two light emitting diodes of the embodiment are driven by the driving power 3.2 watt initially, and the safe temperature value of the object light emitting diode is set to 70° C. Before the temperature of the object light emitting reaches to 70° C., the action of reducing the driving power may not proceed. However, when the object light emitting diode continuously emits light for 1000 seconds, and the temperature of the object light emitting diode achieves to 70° C., the adjustment of the driving power of the object light emitting diode begins.

In the embodiment, the method of adjusting the driving power is to reduce the driving power to an ideal power, to further maintain the temperature of the object light emitting diode, wherein the ideal power is less than the rated driving power of the object light emitting diode. In the process of adjusting the driving power of the object light emitting diode to the ideal power, the temperature of the object light emitting diode is kept at the safe temperature value 70° C. or lower than 70° C. approximately. As shown by the curve TB, during the light emitting range 1000 seconds to 4000 seconds, the final temperature of the object light emitting diode maintains at the safe temperature value 70° C. approximately.

In other aspect, as shown by the curves T32, the light emitting diode with the rated driving power 3.2 watt is driven at the driving power 3.2 watt during the 4000 seconds continuously light emitting time all along, so the temperature of the light emitting diode with the rated driving power 3.2 watt rises continuously.

From the curves LB and L32, the light emitting power of the object light emitting diode and the light emitting power of the light emitting diode with the rated driving power 3.2 watt are close to each other, so that the user has difficult in feeling the differences between' the object light emitting diode and the light emitting diode with the rated driving power 3.2 watt. However, because the driving power of the object light emitting diode needs low driving power (for example the driving power is less than the rated driving power 3.2 watt, when the temperature is higher than the safe temperature value 70° C.)., in the practical use, the object light emitting diode may effectively save electrical energy.

The method of adjusting the driving power to the ideal power is to reduce the driving power stepwise and gradually, and the so-called stepwise and gradually is mainly to avoid that the illumination of the light emitting diode becomes dark obviously and make the user detect or even feel uncomfortable. The following may further show that how the embodiment reduce the driving power of the semiconductor device to the ideal power stepwise and gradually.

Figure 3B:
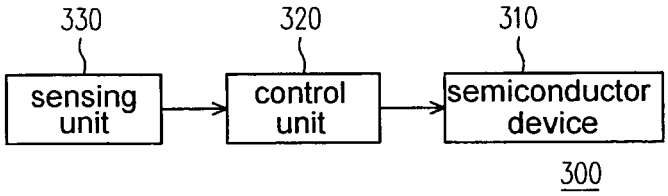
FIG. 3B is a block diagram of a light emitting apparatus according to the second embodiment of the invention.
Figure 3C:
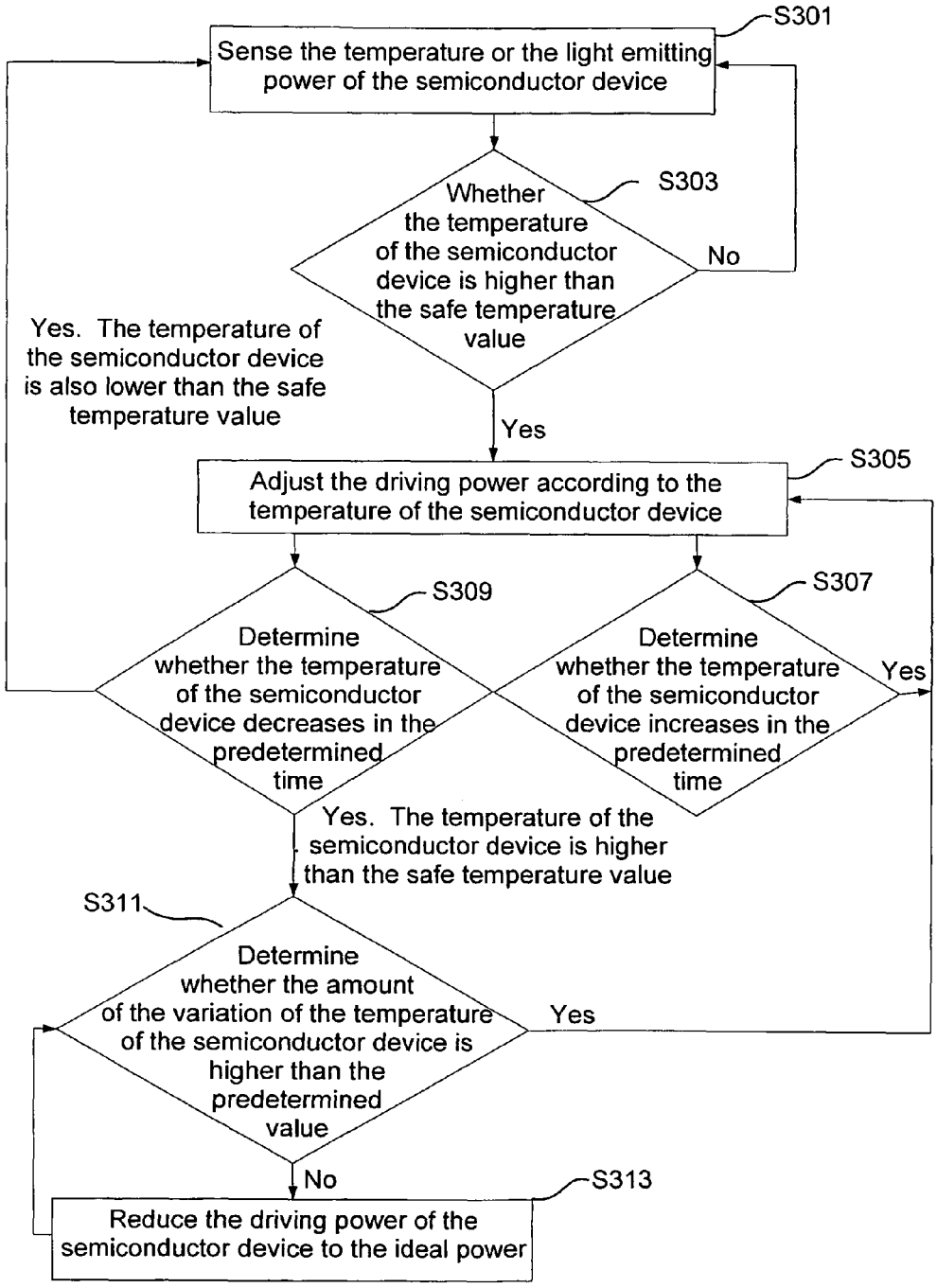
FIG. 3C is a flow diagram of the control method of a light emitting apparatus according to the second embodiment of the invention.

Please refer to FIGS. 3B and 3C, the light emitting apparatus of the embodiment includes a semiconductor device 310 used to emit light and a control unit 320, wherein the semiconductor device 310 used to emit light may be a light emitting diode, a laser diode, or other semiconductor devices capable of emitting light, and the control unit 320 is electronically connected to the semiconductor device 310.

From above, first, the temperature of the semiconductor device 310 is sensed (step S301), in the embodiment, for example, a sensing unit 330 electrically connected to the control unit 320 in the light emitting apparatus 300 is set to sense the semiconductor device 310 and get the temperature of the semiconductor device 310.

In the embodiment, the sensing unit 330 is a thermistor. The thermistor senses the temperature information of the semiconductor device 310 directly. However, in other embodiments, the temperature information of the semiconductor devices 310 may also be got through the relation of the junction temperature, light emitting efficiency, and the driving power of the semiconductor device 310. For example, the sensing unit 330 may be a photo-sensor to sense the light emitting power of the semiconductor device 310, then the control unit 320 further gets the temperature of the semiconductor device 310 according to the light emitting power of the semiconductor device 310 sensed by the sensing unit 330 and the driving power of the semiconductor device 310 (step S301).

Then, the temperature of the semiconductor device 310 is compared with the safe temperature value as a reference of the following action of adjusting the driving power. Taking the 70° C. safe temperature value as an example, the control unit 320 of the embodiment may first determines if the temperature of the semiconductor device 310 is higher than the 70° C. safe temperature value (step S303), to ensure that the temperature of the semiconductor device 310 is substantially higher than the 70° C. safe temperature value before every time reducing the driving power. This action may avoid that the control unit 320 reduces the temperature of the semiconductor device 310 excessively.

When the above-mentioned judging result is that the temperature of the semiconductor device 310 is higher than the 70° C. safe temperature value, the control unit 320 may reduce the driving power of the semiconductor device 310 according to the result (step S305). In this way, the semiconductor device 310 may emit light according to the reduced driving power.

Then, the control unit 320 determines the variation of the temperature of the semiconductor device 310 in a predetermined time, and the result is the reference of whether adjusting the driving power again or not, wherein the semiconductor device 310 emits light by the reduced driving power in a predetermined time. In more detail, suppose the predetermined time to be 1 minute, and the control unit 320 may determine whether the temperature of the semiconductor device 310 rises in 1 minute (step S307). If the temperature rises, the above-mentioned reduced driving power is still too high, so the step S305 is proceeded again, in other words, the control unit 320 reduces the driving power of the semiconductor device 310 again.

In addition, the control unit 320 may also determine if the temperature of the semiconductor device 310 decreases in 1 minute (step S309). If the temperature decreases, and the temperature of the semiconductor device 310 is lower than the 70° C. safe temperature value after 1 minute predetermined time, the above-mentioned reduced driving power is too low, so the step S301 is proceeded again to sense the temperature of the semiconductor device 310 and the light emitting power, to make the adjustment of the driving power be more accurate.

In other aspect, if the control unit 320 determines that the temperature of the semiconductor device 310 decreases in 1 minute, and the temperature of the semiconductor device 310 is still higher than the 70° C. safe temperature value after 1 minute predetermined time, the control unit 320 determines if the variation amplitude of the temperature of the semiconductor device 310 is higher than a predetermined value in 1 minute predetermined time (step S311) as a reference to decide whether to adjust the driving power again. The step may avoid that the control unit 320 reduces the temperature of the semiconductor devices 310 excessively.

From above, suppose the above-mentioned predetermined value is 3° C. When the control unit 320 determines that the variation amplitude of the temperature of the semiconductor device 310 is higher than 3° C. predetermined value in 1 minute predetermined time, the result means the driving power of the semiconductor device 310 has not reduced to the ideal power, so the step S305 is proceeded again to further make the control unit 320 adjust the driving power of the semiconductor device 310. If the variation amplitude of the temperature device 310 is higher than 3° C. and the temperature of the semiconductor device 310 decreases below the 70° C. safe temperature value, the step S305 is proceeded again to further make the control unit 320 increase the driving power of the semiconductor device 310; or if the variation amplitude of the temperature device 310 is higher than 3° C. and the temperature of the semiconductor device 310 is still higher than the 70° C. safe temperature value, the step S305 is proceeded again to further make the control unit 320 decrease the driving power of the semiconductor device 310. Contrarily, if the control unit 320 determines that the variation amplitude of the temperature of the semiconductor device 310 is not higher than 3° C. predetermined value in 1 minute predetermined time, the result means the driving power of the semiconductor device 310 has reduced to the ideal power (step S313), and the temperature of the semiconductor device 310 is the safe temperature value higher or lower.

After that, the control unit 320 may still proceed the step S311 continuously, that is to determine if the variation amplitude of the temperature of the semiconductor device 310 is higher than 3° C. predetermined value in 1 minute predetermined time to ensure the temperature of the semiconductor device 310 maintain at the safe temperature value.

The above-mentioned steps S305, S307, S309, S311, and S313 are adjusted and determined according to the temperature of the semiconductor device 310 mainly. However, because the relations of the junction temperature, light emitting power, and the driving power of the semiconductor device 310 are depended on each other, in other embodiments, the steps S305, S307, S309, S311, and S313 may also be adjusted and determined according to the light emitting power (that is illumination) of the semiconductor device 310.

From above, the embodiment not only has the advantages of the first embodiment, but also further takes consideration of the safe temperature value of the semiconductor device to make the light emitting apparatus using the semiconductor device have more stable light emitting illumination and higher level safety specialist.

In summary, the embodiment or embodiments of the invention may have at least one of the following advantages: the control method of the light emitting apparatus includes reducing the driving power of the semiconductor device in the light emitting apparatus to the ideal power stepwise and gradually, to make the light emitting apparatus have the advantages of low power consumption, long service life, high reliability, and high level safety specialist.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the disclosure is intended to be dedicated to the public regardless of whether the element or component is explicitly recited in the following claims.

What is claimed is:

1. A control method of a light emitting apparatus, the light emitting apparatus having a semiconductor device for emitting light, the control method comprising the following steps:

stepwise and gradually reducing a driving power of the semiconductor device to an ideal power, wherein the semiconductor device continually emits the light by the reduced driving power within a predetermined time after every time the driving power of the semiconductor device is reduced;

sensing a temperature of the semiconductor device;

comparing the temperature of the semiconductor device with a safe temperature value, wherein the temperature of the semiconductor device is higher than the safe temperature value before every time reducing the driving power;

wherein the step of stepwise and gradually reducing the driving power of the semiconductor device to the ideal power comprises:

determining whether the temperature of the semiconductor device decreases in the predetermined time after every time reducing the driving power;

determining whether an amount of a variation of the temperature of the semiconductor device is higher than a predetermined value if the temperature of the semiconductor device decreases in the predetermined time and the temperature of the semiconductor device is still higher than the safe temperature value after the predetermined time; and adjusting the driving power of the semiconductor device if the amount of the variation of the temperature of the semiconductor device is higher than the predetermined value in the predetermined time.

2. The control method as claimed in claim 1, wherein the step of stepwise and gradually reducing the driving power of the semiconductor device to the ideal power further comprises:

determining whether the temperature of semiconductor device increases in the predetermined time after every time reducing the driving power; and reducing the drive power if the temperature of the semiconductor device increases in the predetermined time.

3. The control method as claimed in claim 1, wherein the step of stepwise and gradually reducing the driving power of the semiconductor device to the ideal power further comprises:

sensing the temperature of the semiconductor device if the temperature of the semiconductor device decreases in the predetermined time and the temperature of the semiconductor device is lower than the safe temperature value after the predetermined time.

4. The control method as claimed in claim 1, wherein the driving power of the semiconductor device is reduced through reducing a driving current of the semiconductor device.

5. The control method as claimed in claim 1, wherein the ideal power is less than a rated driving power of the semiconductor device.

6. A light emitting apparatus, comprising:

a semiconductor device, for emitting light;

a control unit, electrically connected to the semiconductor device and for stepwise and gradually reducing a driving power of the semiconductor device to an ideal power, wherein the semiconductor device continually emits the light by the reduced driving power within a predetermined time after every time the driving power of the semiconductor device is reduced; and a sensing unit electrically connected to the control unit to sense a temperature of the semiconductor device;

wherein the control unit compares the temperature of the semiconductor device with a safe temperature value and the temperature of the semiconductor device is higher than the safe temperature value before every time reducing the driving power;

wherein the control unit determines whether the temperature of the semiconductor device decreases in the predetermined time after every time reducing the driving power;

wherein the control unit determines whether an amount of a variation of the temperature of the semiconductor device is higher than a predetermined value if the temperature of the semiconductor device decreases in the predetermined time and the temperature of the semiconductor device is still higher than the safe temperature value after the predetermined time; and wherein the control unit adjusts the driving power of the semiconductor device if the amount of the variation of the temperature of the semiconductor device is higher than the predetermined value in the predetermined time.

7. The light emitting apparatus as claimed in claim 6, wherein the control unit determines whether the temperature of the semiconductor device increases in the predetermined time after every time reducing the driving power, and the control unit reduces the drive power if the temperature of the semiconductor device increases in the predetermined time.

8. The light emitting apparatus as claimed in claim 6, wherein the control unit reduces the driving power of the semiconductor device through reducing a driving current of the semiconductor device.

9. The light emitting apparatus as claimed in claim 6, wherein the ideal power is less than a rated driving power of the semiconductor device.

10. A control method of a light emitting apparatus, the light emitting apparatus having a semiconductor device for emitting light, the control method comprising the following steps:

stepwise and gradually reducing a driving power of the semiconductor device to an ideal power, wherein the semiconductor device continually emits the light by the reduced driving power within a predetermined time after every time the driving power of the semiconductor device is reduced;

sensing a light emitting power of the semiconductor device;

getting a temperature of the semiconductor device according to the driving power of the semiconductor device and the light emitting power sensed by the semiconductor device; and comparing the temperature of the semiconductor device with a safe temperature value, wherein the temperature of the semiconductor device is higher than the safe temperature value before every time reducing the driving power;

wherein the step of stepwise and gradually reducing the driving power of the semiconductor device to the ideal power comprises:

determining whether the temperature of the semiconductor device decreases in the predetermined time after every time reducing the driving power;

determining whether an amount of a variation of the temperature of the semiconductor device is higher than a predetermined value if the temperature of the semiconductor device decreases in the predetermined time and the temperature of the semiconductor device is higher than the safe temperature value after the predetermined time; and adjusting the driving power of the semiconductor device if the amount of the variation of the temperature of the semiconductor device is higher than the predetermined value in the predetermined time.

11. The control method as claimed in claim 10, wherein the step of stepwise and gradually reducing the driving power of the semiconductor device to the ideal power further comprises:

determining whether the temperature of semiconductor device increases in the predetermined time after every time reducing the driving power; and reducing the drive power if the temperature of the semiconductor device increases in the predetermined time.

12. The control method as claimed in claim 10, wherein the step of stepwise and gradually reducing the driving power of the semiconductor device to the ideal power further comprises:

sensing the temperature of the semiconductor device if the temperature of the semiconductor device decreases in the predetermined time and the temperature of the semiconductor device is lower than the safe temperature value after the predetermined time.

13. The control method as claimed in claim 10, wherein the driving power of the semiconductor device is reduced through reducing a driving current of the semiconductor device.

14. The control method as claimed in claim 10, wherein the ideal power is less than a rated driving power of the semiconductor device.

15. A light emitting apparatus, comprising:

a semiconductor device, for emitting light;

a control unit, electrically connected to the semiconductor device and for stepwise and gradually reducing a driving power of the semiconductor device to an ideal power, wherein the semiconductor device continually emits the light by the reduced driving power within a predetermined time after every time the driving power of the semiconductor device is reduced; and a light sensing unit electrically connected to the control unit to sense a light emitting power of the semiconductor device, wherein the control unit gets the temperature of the semiconductor device according to the driving power of the semiconductor device and the light emitting power sensed by the semiconductor device, the control unit compares the temperature of the semiconductor device with a safe temperature value, and the temperature of the semiconductor device is higher than the safe temperature value before every time reducing the driving power;

wherein the control unit determines whether the temperature of the semiconductor device decreases in the predetermined time after every time reducing the driving power;

wherein the control unit determines whether an amount of a variation of the temperature of the semiconductor device is higher than a predetermined value if the temperature of the semiconductor device decreases in the predetermined time and the temperature of the semiconductor device is higher than the safe temperature value after the predetermined time; and wherein the control unit adjusts the driving power of the semiconductor device if the amount of the variation of the temperature of the semiconductor device is higher than the predetermined value in the predetermined time.

16. The light emitting apparatus as claimed in claim 15, wherein the control unit determines whether the temperature of the semiconductor device increases in the predetermined time after every time reducing the driving power, and the control unit reduces the drive power if the temperature of the semiconductor device increases in the predetermined time.

17. The light emitting apparatus as claimed in claim 15, wherein the control unit reduces the driving power of the semiconductor device through reducing a driving current of the semiconductor device.

18. The light emitting apparatus as claimed in claim 15, wherein the ideal power is less than a rated driving power of the semiconductor device.

* * * * *